US007473438B2

(12) United States Patent
Sandor

(10) Patent No.: US 7,473,438 B2
(45) Date of Patent: Jan. 6, 2009

(54) REMOVABLE TWO-PART GLAZE AND TEXTURED PAINT SYSTEM FOR DECORATIVE FINISHING

(76) Inventor: Raymond Sandor, 3435 Aviation Blvd., Vero Beach, FL (US) 32960

( * ) Notice: Subject to any disclaimer, the term of this patent is extended or adjusted under 35 U.S.C. 154(b) by 171 days.

(21) Appl. No.: 11/085,801

(22) Filed: Mar. 21, 2005

(65) Prior Publication Data

US 2005/0208202 A1 Sep. 22, 2005

Related U.S. Application Data

(60) Provisional application No. 60/555,439, filed on Mar. 22, 2004.

(51) Int. Cl.
*B05D 5/00* (2006.01)
*B05D 3/12* (2006.01)

(52) U.S. Cl. ..... 427/262; 427/265; 427/274

(58) Field of Classification Search ..... 427/262, 427/265, 274

See application file for complete search history.

(56) References Cited

U.S. PATENT DOCUMENTS

| | | | | |
|---|---|---|---|---|
| 3,639,160 | A * | 2/1972 | Nelson | 427/226 |
| 6,630,533 | B2 * | 10/2003 | Konopka et al. | 524/560 |
| 6,727,315 | B2 * | 4/2004 | Yamamoto et al. | 524/558 |
| 2002/0009622 | A1 * | 1/2002 | Goodson | 428/703 |

OTHER PUBLICATIONS

Encyclopedia of Materials Science and Engineering, pp. 3648-3649,, 1986.*

McGraw Hill Dictionary of Chemistry, p. 309, 1997.*

* cited by examiner

*Primary Examiner*—Frederick J Parker
(74) *Attorney, Agent, or Firm*—David A. Cherry; Feldman Gale, P.A.

(57) ABSTRACT

A process for making a faux finish with a two-part reactive system of materials includes providing a base material liquid of Poly Vinyl Acetate resin and water mixed with a dry powder functional filler and adding an activating liquid to the base material liquid. The activating liquid is a mixture of water and muriate of potash or boric acid product.

22 Claims, 1 Drawing Sheet

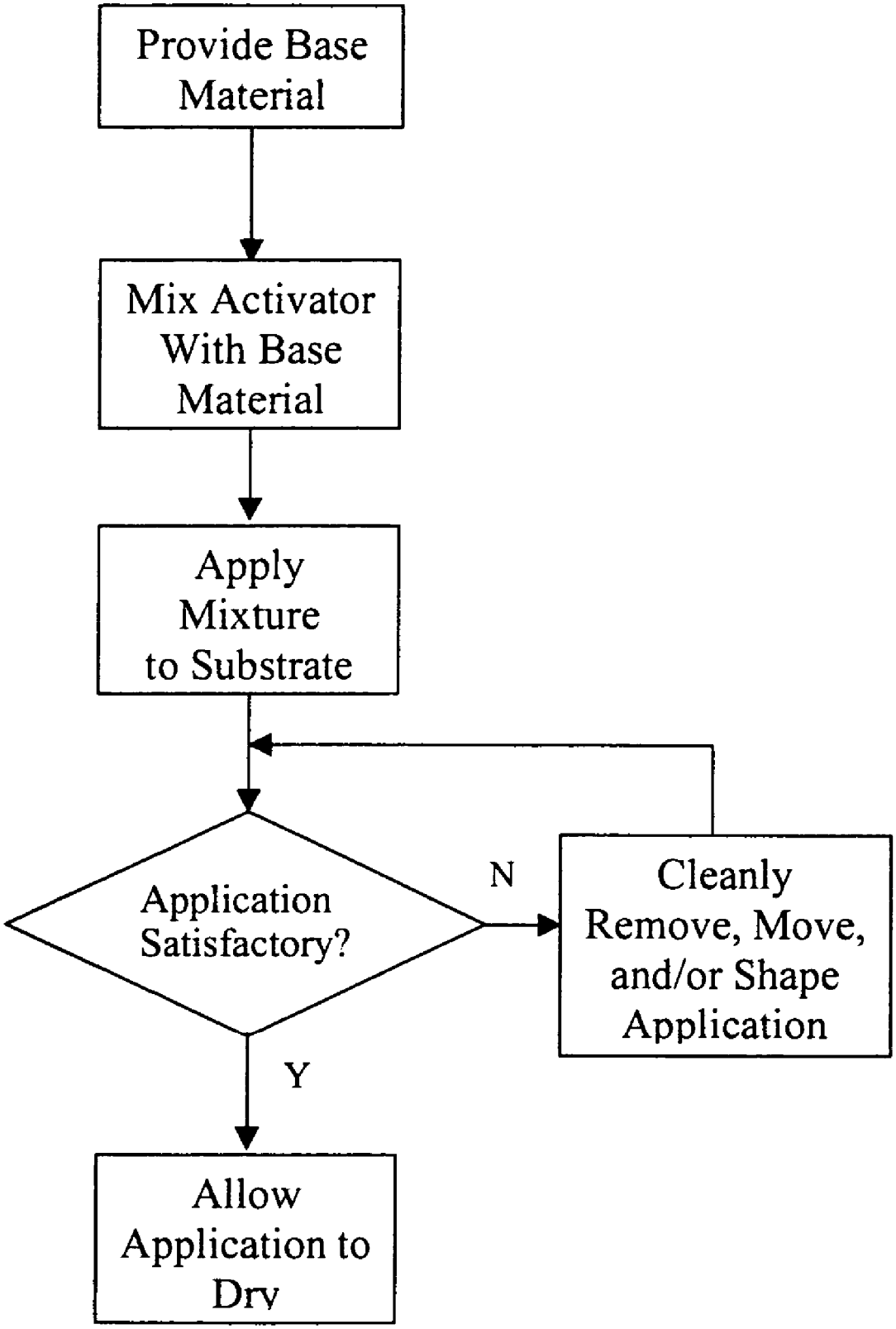
Provide Base Material
Mix Activator With Base Material
Apply Mixture to Substrate
Application Satisfactory?
N
Cleanly Remove, Move, and/or Shape Application
Y
Allow Application to Dry

REMOVABLE TWO-PART GLAZE AND TEXTURED PAINT SYSTEM FOR DECORATIVE FINISHING

CROSS-REFERENCE TO RELATED APPLICATION

This application claims the benefit under 35 U.S.C. § 119 (e) of U.S. Provisional Application No. 60/555,439, filed Mar. 22, 2004, the complete disclosure of which is hereby incorporated by reference herein in its entirety.

BACKGROUND OF THE INVENTION

Field of the Invention

The invention lies in the field of finishes, in particular, faux finishes.

One way to decorate a wall is to place artwork or sculptures thereon. Another way is to use the wall, itself, as the artwork. To place texture or patterns into or onto the wall, various faux finishes exist. However, such finishes are hard to work with and do not allow the artist the time and flexibility to change the texture as desired and to do so for a substantial period of time after the finish is applied to the wall.

Therefore, it would be desirable to provide a faux finish that, when applied, provides a puffed and grainy structure that is very easy to cleanly and sharply remove from the substrate on which it is applied. After applying the faux finish to a surface it would be desirable for the faux finish to be cleanly removed by simply touching the applied faux finish. It would further be desirable for the applied mixture to remain workable in this cleanly removable fashion for up to one hour. When fully dry, it would be desirable if the faux finish becomes well bonded to the underlying base coat, metal, or other bondable substrate.

SUMMARY OF THE INVENTION

It is accordingly an object of the invention to provide a removable two-part glaze and textured paint system for decorative finishing that overcomes the hereinafore-mentioned disadvantages of the heretofore-known devices and methods of this general type and that allows for the application of both relatively smooth and textured decorative finishes that are constructed with an inventive two-part reactive system of materials. The new materials and methods are used in a two-part reactive system to produce decorative finished patterns including cleanly and sharply defined edges for removable glazes, textured stone, and plaster finishes.

Normal finishing materials and methods presently available in the marketplace do not perform as, or have the physical properties of the two-part reactive system of materials and methods for producing positive and negative material effects decorative finishes according to the present invention.

A color-tintable paint-like base material is provided on the surface first. Then, the textured system of the present invention is placed thereon. With the textured system of the present invention, the application artist can control the amount of texture and anti-bonding resistance to a substrate on which the textured system is applied. A base material (Part A) is applied over a painted base coat or other bondable substrate with an activator (Part B), added in various amounts, into the base material. Depending upon the amount of activator added, the textured system has differing properties. The result is a decorative finishing material with new and unique adjustable physical properties that the applicator has working control of by the amount of activator added to the base material.

The additions of the activator into the base material changes the physical properties of the base material, which becomes somewhat puffed, grainy, and very easy to cleanly and sharply remove from the substrate on which it is applied. Thus, after brushing rolling, spraying, or troweling on the mixture to a surface, it can be cleanly removed in any section by simply touching the applied mixture with a dry cloth or paper towel, which, depending upon the user's desire can expose the substrate below. The applied mixture remains workable in this cleanly removable fashion for about fifteen minutes to one hour, making for easy removal or adding additional material and, again, removing the applied mixture from the substrate without mess, without smearing the applied mixture, and without turning the mixture application muddy with respect to the decorative positive and negative material patterns. When fully dry, the material becomes well bonded to the underlying base coat, metal, or other bondable substrate.

During the drying stages of the finish, and when the applied mixture becomes firm, it can be burnished or flattened down, if desired, with pressure using a plastering or finishing trowel, making for a smoother finish.

Another method of producing a decorative finish using the two part system of the present invention is to add a color tint to the base material and, then, adding, by mixing in, the desired amount of activator to a sufficient extent to make the mixture at least puffy and grainy. The mixture is, then, spattered or sponged onto a substrate at random, but not with full coverage. The applied mixture is lightly spread upon the subsurface using an application trowel or brush. The randomly applied mixture is cleanly removed without mess in any desired areas with a dry cloth or paper towel, thus refining and exposing as much of the underlying substrate color as desired. The mixture remaining on the substrate can be flattened-down and further refined by even more detail removal, if desired, then burnished, if desired, using a finishing trowel when the mixture is firm and not completely dry.

Another method of producing a decorative finish is to color tint one or two or more separate volumes of the base material. Then, larger amounts of activator are added. The resulting mixture is a very grainy, thick, and chunky mixture that is unable to hold together and that will separate naturally when applied by brush or trowel to a substrate. The resulting application will be broken color patterns with only light clean touch-up removal needed, if desired.

The new system may be applied in more than one layer. When one layer of the base material and activator mixture is applied and randomly removed and allowed to dry, a new layer of the same or a different color of the mixture can be applied over and, again, randomly removed, resulting in a more dimensional finish.

Faux marbling is much easier to accomplish using the method according to the invention. The ability to color tint and to cleanly and sharply remove the material where desired makes marbling easy to achieve. First, the artisan rough paints in the basic marble patterns. Then, the artisan cleanly removes the material into a more refined marble creation. Any mistakes in the removal of the material can be repaired by simply painting in more of the mixture and, again, cleanly removing the mixture where needed, without any risk of smearing or messing up the marble patterns.

Another advantage of the present invention can be seen clearly when producing stone-like finishes over a textured substrate. The mixture of the invention is easily and cleanly removed exposing the textured substrate below. Normal paints and glazes are entirely unable to be removed cleanly with sharp edge material patterns over any substrates and, especially, when applied over a textured substrate.

BRIEF DESCRIPTION OF THE DRAWINGS

The FIGURE is a flow chart illustrating the steps according to the invention.

DESCRIPTION OF THE PREFERRED EMBODIMENTS

Referring now to the single FIGURE of the drawing, it is seen that the invention is a process for making a relatively smooth and textured decorative finish (also referred to as a "faux finish") with a two-part reactive system of materials.

The process includes a base material, in particular, a first liquid product of Poly Vinyl Acetate resin and water mixed with dry powder functional fillers. Color may also be added to this mixture.

The base material is, preferably, composed of the following:

approximately 5% to 25% by weight of solids of an aqueous dispersion of a polymer of Vinyl Acetate having protective colloids of Poly Vinyl Alcohol;

approximately 10% to 80% by weight of water;

approximately 0 to 20% by weight of Propylene Glycol; and approximately 5% to 70% by weight of functional fillers, including dry micron waxes.

A second liquid is added to the first liquid. The second liquid preferably includes water and a small amount of the muriate of potash or boric acid product sold under the trademarks 20 MULE TEAM® or U.S. BORAX®. This second liquid is referred to as an activator.

The activator is, preferably, composed of a mixture of one gallon of water and approximately 0.5 to approximately 10 ounces by volume of Sodium tetra borate decahydrate dry powder to each gallon of water.

When the activator is added to the aqueous dispersion polymer of Poly Vinyl Acetate resin mixture, there is a separating incompatibility reaction making the material workable but not easy to stick to a painted substrate when brushed or toweled thereon. As the mixture is allowed to dry, however, it bonds to the painted substrate and becomes a permanent decorative finish to the substrate on which it is placed. It is important to note that if the specific application is not desired, then the applied material can be easily removed—for at least fifteen minutes to 1 hour after application—merely by using a dry absorbent cloth (i.e., paper towel) or can be easily moved into decorative patterns without mess or smudges wherever the applying artisan desires.

The invention claimed is:

1. A process for making a faux finish which comprises:

contacting a base material liquid comprising:

about 5% to about 25% by weight of solids of an aqueous dispersion of a polymer of Vinyl Acetate having colloids of Poly Vinyl Alcohol;

about 10% to about 80% by weight of water;

0% to about 20% by weight of Propylene Glycol; and about 5% to about 70% by weight of a functional filler;

with an activating liquid, wherein the activating liquid comprises water and one of a muriate of potash and a compound that includes boric acid to produce a faux finish product;

applying the faux finish product to a surface to be decorated; and selectively altering the applied finish for up to one hour after application on the surface, wherein the selective altering step comprises selectively removing the applied finish from the surface to expose the surface.

2. The process according to claim 1, wherein the contacting step comprises adding the activating liquid to the base material liquid.

3. The process according to claim 1, wherein the activating liquid is a mixture of water and sodium tetra borate decahydrate dry powder having a ratio of about 0.5 to about 10 ounces by volume of sodium tetra borate decahydrate dry powder per gallon of water.

4. The process according to claim 1, wherein the functional filler is a dry wax.

5. The process according to claim 1, which further comprises adding color to the base material liquid.

6. The process according to claim 1, wherein the base material liquid is colored.

7. The process according to claim 1, which further comprises:

allowing the faux finish product to partially dry; and altering the shape of the applied faux finish product while the applied faux finish product is still on the surface.

8. The process according to claim 7, comprising altering the shape of the applied faux finish product within one hour after application of the faux finish product.

9. The process according to claim 1, which further comprises painting the surface with a base coat before the faux finish product is applied to the surface and, thereby, form a textured finish over the base coat.

10. The process according to claim 1, wherein the application step comprises at least one of brushing, rolling, spraying, and troweling the faux finish product on the surface.

11. The process according to claim 9, which further comprises:

allowing the applied faux finish product to partially dry; and altering the shape of the applied faux finish product while the applied faux finish product is still on the base coat.

12. The process according to claim 11, comprising altering the shape of the applied faux finish product within one hour after application of the faux finish product.

13. The process according to claim 1, which further comprises allowing the applied faux finish product to completely dry and bond to the surface.

14. The process according to claim 1, which further comprises:

allowing the applied faux finish product to partially dry upon the surface; and at least one of burnishing and flattening the applied faux finish product while it is still on the surface.

15. The process according to claim 1, which further comprises spattering the faux finish product on a surface to be decorated without full coverage to form a textured finish over the surface.

16. The process according to claim 1, which further comprises sponging the faux finish product on a surface to be decorated without full coverage to form a textured finish over the surface.

17. The process according to claim 1, which further comprises carrying out the applying step more than once to apply the faux finish product in more than one layer.

18. The process according to claim 17, which further comprises:

allowing a first layer of the applied faux finish product to dry on the surface; and applying a new layer of the faux finish product over the dried first layer, the new layer having one of the same color, a different color and a mixture of the same color and a different color.

19. A process for creating a semi-removable two-part glaze and textured paint system for decorative finishing, comprising:

mixing a base material (part A) with an amount of activator (part B) to produce a decorative finish having textural properties dependent upon the amount of activator added;

applying the decorative finish to a surface to be decorated; and selectively altering the applied finish for up to one hour after application on the surface, wherein the selective altering step comprises selectively removing the applied finish from the surface to expose the surface;

wherein:

part A comprises:

about 5% to about 25% by weight of solids of an aqueous dispersion of a polymer of Vinyl Acetate having colloids of Poly Vinyl Alcohol;

about 10% to about 80% by weight of water;

0% to about 20% by weight of Propylene Glycol; and about 5% to about 70% by weight of a functional filler; and part B comprises water and one of a muriate of potash and a compound that includes boric acid.

20. The process according to claim 19, wherein the altering step comprises rubbing the applied finish.

21. The process according to claim 19, which further comprises allowing the applied faux finish product to completely dry and bond to the surface.

22. A process for making a faux finish with a two-part reactive system of materials, which comprises:

providing a base material liquid comprising:

about 5% to about 25% by weight of solids of an aqueous dispersion of a polymer of Vinyl Acetate having colloids of Poly Vinyl Alcohol;

about 10% to about 80% by weight of water;

0% to about 20% by weight of Propylene Glycol; and about

5% to about 70% by weight of a functional filler; and adding an activating liquid to the base material liquid, the activating liquid being a mixture of water and one of a muriate of potash and a compound containing boric acid.

* * * * *